US007975720B2

(12) United States Patent
Conway

(10) Patent No.: US 7,975,720 B2
(45) Date of Patent: Jul. 12, 2011

(54) BALL VALVE CARTRIDGE FOR USE WITH REMOTE HANDLE

(76) Inventor: Scott T. Conway, Sylvania, OH (US)

( * ) Notice: Subject to any disclaimer, the term of this patent is extended or adjusted under 35 U.S.C. 154(b) by 274 days.

(21) Appl. No.: 12/383,566

(22) Filed: Mar. 25, 2009

(65) Prior Publication Data

US 2009/0242039 A1 Oct. 1, 2009

Related U.S. Application Data

(60) Provisional application No. 61/070,576, filed on Mar. 25, 2008.

(51) Int. Cl.
*E03B 9/02* (2006.01)

(52) U.S. Cl. ..... 137/614.2; 137/301; 137/283; 137/454.5; 251/288

(58) Field of Classification Search ..... 137/360, 137/272, 301, 614.2, 454.5, 454.6, 283, 300, 137/613; 251/288, 286, 287, 315.01, 315.16
See application file for complete search history.

(56) References Cited

U.S. PATENT DOCUMENTS

| | | | | |
|---|---|---|---|---|
| 5,158,105 | A * | 10/1992 | Conway | 137/360 |
| 5,392,805 | A * | 2/1995 | Chrysler | 137/218 |
| 6,197,195 | B1 * | 3/2001 | Booth et al. | 137/454.6 |
| 6,880,573 | B2 * | 4/2005 | Berkman et al. | 137/614.2 |
| 7,357,145 | B2 * | 4/2008 | Soderberg et al. | 137/454.6 |

* cited by examiner

*Primary Examiner* — Kevin L Lee
(74) *Attorney, Agent, or Firm* — David C. Purdue

(57) ABSTRACT

A ball valve cartridge is disclosed. It is especially well suited for freezeless hydrant applications and any other application where it is positioned remotely from a handle or other actuating element. The cartridge contains a ball valve element and an internal stem with a key for rotating the ball valve element between open and closed positions. The stem has rotational stop elements that limit rotational movement of the stem and the ball valve element. In a yard hydrant application, a drain valve can be added to regulate the opening and closing of the drain hole. It has an operational range of a quarter turn or ninety degrees.

20 Claims, 8 Drawing Sheets

BALL VALVE CARTRIDGE FOR USE WITH REMOTE HANDLE

BACKGROUND OF THE INVENTION

1. Field of the Invention

The present invention is a ball valve cartridge especially adapted for use in applications where it is actuated by a remotely positioned handle, such as in freezeless wall hydrants or faucets and yard hydrants.

2. Description of the Prior Art

The field of valves for regulating and controlling fluid flow is certainly well developed. Self-draining yard hydrants and freezeless wall faucets, wall hydrants, sillcocks or bibcocks, are also well known.

Yard hydrants are described in many US Patents, including U.S. Pat. No. 4,372,339. Freezeless wall hydrants are also described by many U.S. Patents, including my prior U.S. Pat. No. 5,158,105.

A freezeless sillcock with ceramic disk valve elements is described in U.S. Pat. No. 6,880,573. This device has an operating range constituting only one quarter of a turn of an actuator handle. However, the components of the ceramic disk are contained within a cartridge and, in a commercial embodiment of this invention, the disks are under heavy compression exerted by very strong springs. That makes this unit subject to failure due to spring failure, as well as failure of the disks themselves. Ceramic has a very different co-efficient of expansion than steel and brass and copper and, in extreme temperatures such as those encountered in the freezeless application under consideration, this may lead to failure, as well. Ceramic disk cartridges can retain water so that freezing may lead to catastrophic failure. The flow rate through ceramic disk valve elements is generally less than the flow rate through a comparable ball valve element. Flow rate is also limited in ceramic valve elements by size limitations imposed by the ceramic material itself. Ceramic disk valve elements are more prone to sediment blockage than ball valve elements. Ceramic valve elements are made of ceramics while ball valve elements can be made of almost any material including, without limitation, brass, stainless steel, iron, PVC, Delrin, nylon and so on.

Generally speaking, the machining of ceramic parts can leave flaws which can cause premature failure of those parts. Ceramic parts generally cost more than do metal parts. Because ceramics are so hard, mating surfaces tend to wear more quickly than mating surfaces of parts made from other materials. The hardness of ceramics makes them generally more difficult to machine. Ceramics require more expensive abrasive materials and must be machined more slowly than metal to avoid damage.

It is submitted that there is a need for a cartridge style valve that is actuated over a quarter turn, like the ceramic freezeless ceramic disk valve hydrant mentioned above, that is more reliable, easier to produce, less expensive, and more resistant to extreme temperature fluctuations such as those encountered in freezeless hydrant applications.

SUMMARY OF THE INVENTION

The instant invention is based upon the discovery of a new ball valve and, specifically, one that is contained within a cartridge so that it can be positioned remotely from a handle or other actuating element. The cartridge contains a ball valve element and an internal stem with a key for rotating the ball valve element between open and closed positions. The stem has rotational stop elements that cooperate with rotational stops inside the cartridge to limit rotational movement of the stem and the ball valve element. In a yard hydrant application, a drain valve can be added to regulate the opening and closing of the drain hole in cooperation with the water valve operation. The cartridge itself is very compact and permits the positioning of the ball further from the actuator than prior art ceramic disk cartridges, thereby increasing the freeze resistance of a hydrant including the ball valve cartridge.

It is, therefore, an object of the invention to provide an improved ball valve especially adapted for actuation by a remote handle, such as in a freezeless hydrant application.

It is another object to provide an improved freezeless hydrant including the ball valve cartridge.

It is a further object of the invention to provide a hydrant with an easily replaceable valve mechanism.

It is yet a further object of the invention to provide a hydrant with the preferred quarter turn operation that is better than the prior art freezeless hydrants including ceramic disk cartridges.

Other objects and advantages will be apparent to one skilled in the art from the description herein, reference being made to the attached drawings.

BRIEF DESCRIPTION OF THE DRAWING FIGURES

DETAILED DESCRIPTION OF THE INVENTION

Figure 1A:
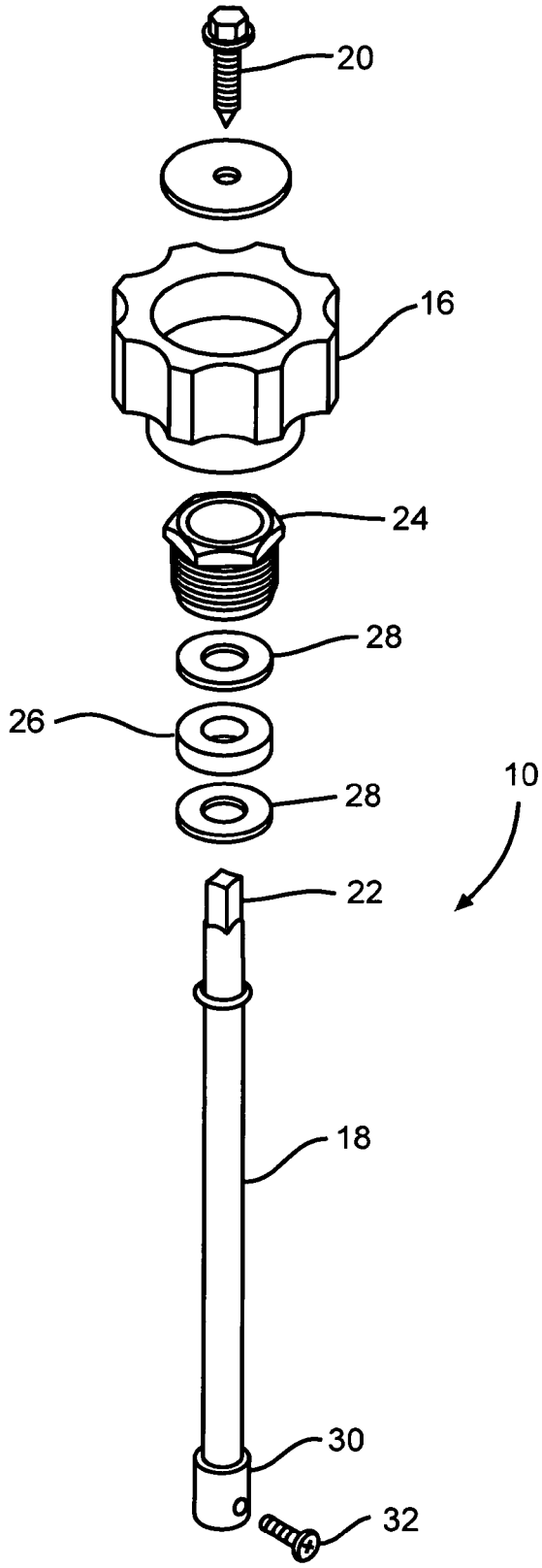
FIG. 1A is an exploded view showing elements of a valve stem assembly for use with a ball valve cartridge according to the invention in a freezeless hydrant application.
Figure 1B:
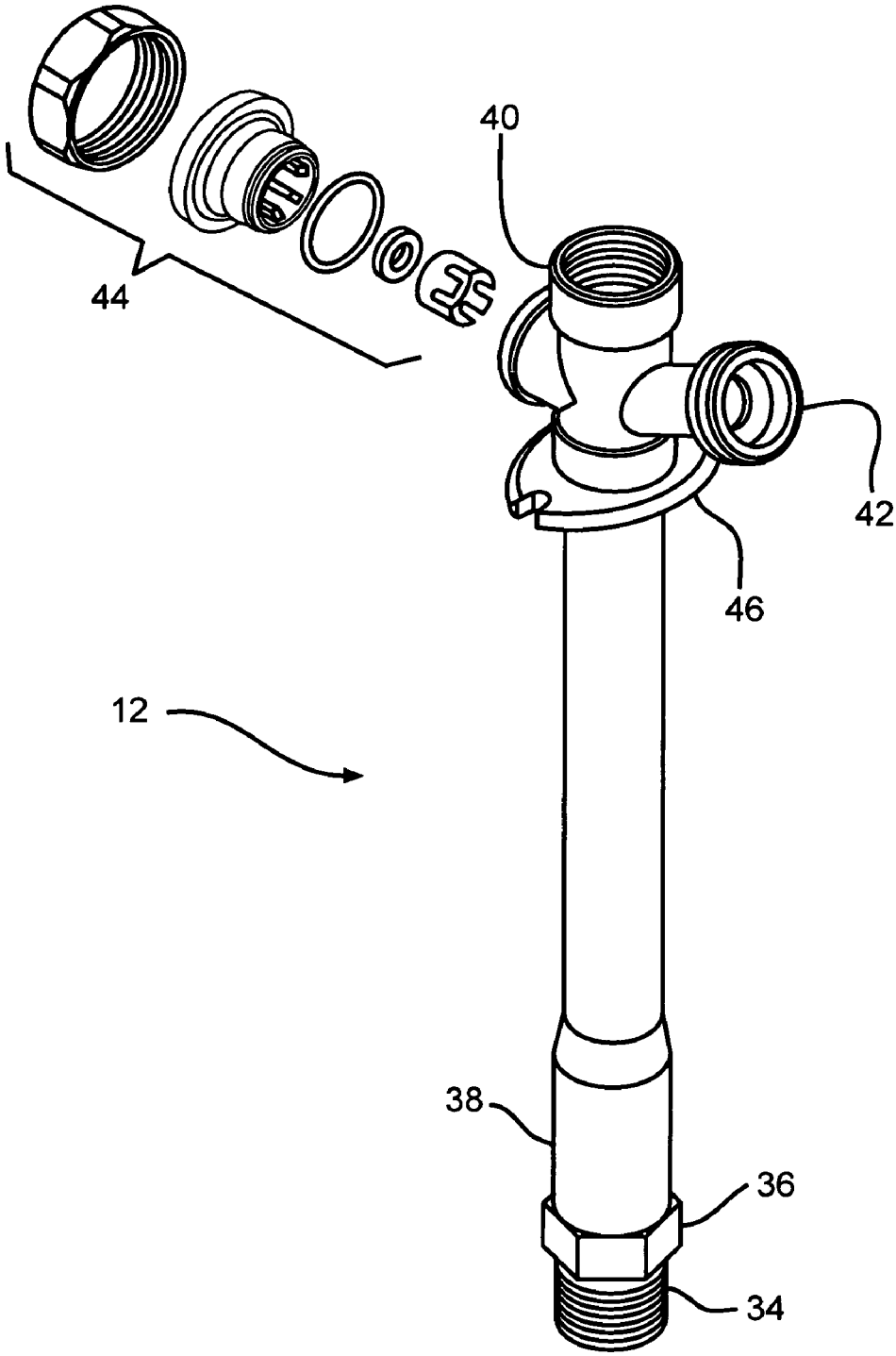
FIG. 1B is an exploded view of a freezeless wall hydrant tube including a vacuum breaker mechanism.
Figure 1C:
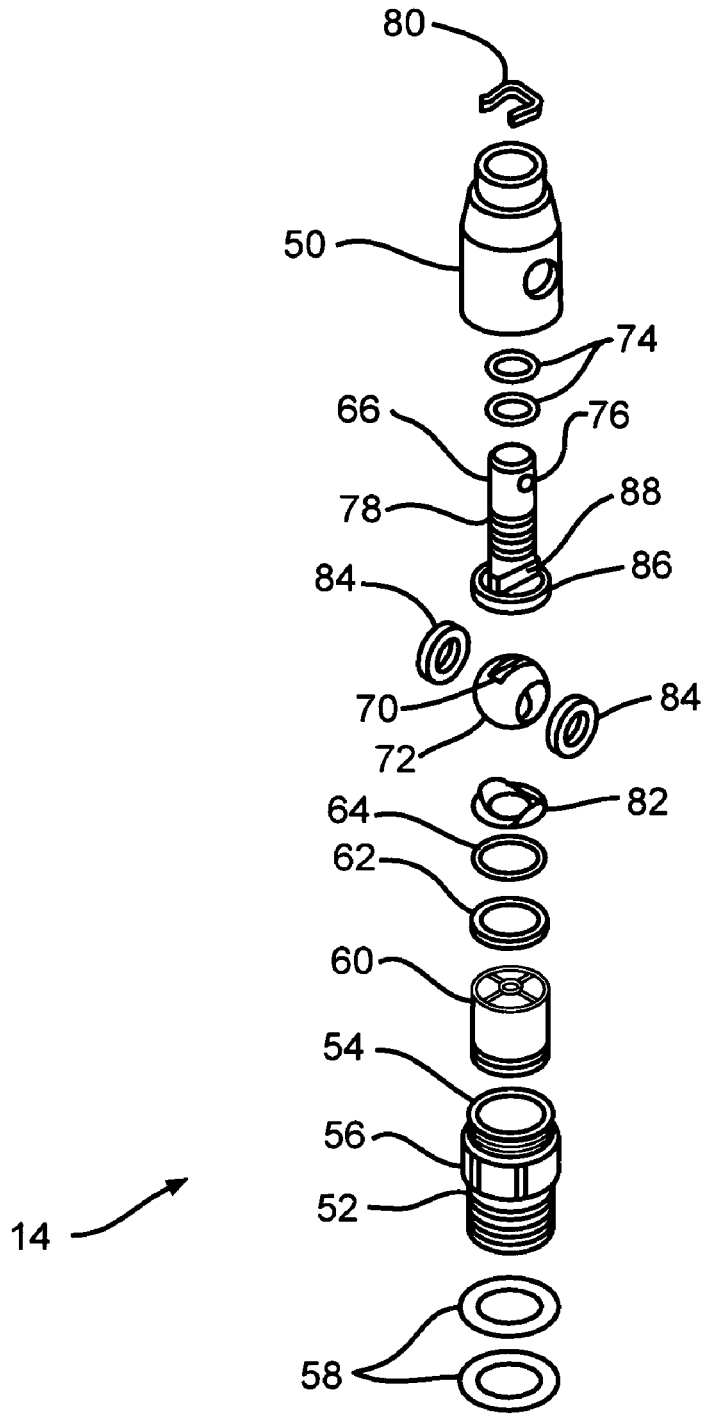
FIG. 1C is an exploded view showing the elements of a ball valve cartridge according to the invention.

Referring now in more detail to the drawing figures, a freezeless sillcock according to the invention comprises an actuator indicated generally at 10 in FIG. 1A, a sillcock tube indicated generally at 12 in FIG. 1B and a ball valve cartridge indicated generally at 14 in FIG. 1C. The actuator 10 comprises a handle 16 (FIG. 1A) which is drivingly connected to a stem 18 by a fastener 20. Torque imparted to the handle 16 is transmitted to the stem 18 through torque surfaces 22 on the stem 18 which are engaged by corresponding surfaces (not shown) on the handle 16. A packing nut 24, packing 26 and washers 28 secure the stem 18 within the sillcock tube 12 (FIG. 1B). At the distal end 30 (FIG. 1A) of the stem 18, a torque transmitting element is provided for transmitting torque from the stem 18 to the cartridge 14. The torque transmitting element shown is a fastener 32 although any torque transmitting element will suffice.

The sillcock tube 12 (FIG. 1B) is threaded as indicated at 34 at the distal end to engage a valve seat (not shown). A wrench hex 36 is provided near the distal end, adjacent to a flared portion 38 of the tube 12 in which the cartridge 14 (FIG. 1C) will be received. At the proximal end of the tube 12 (FIG. 1B), an internally threaded portion 40 is provided for receiving the packing nut 24 (FIG. 1A). An externally threaded hose bib 42 is also provided at the proximal end of the tube. A vacuum breaker assembly, indicated at 44, is connected to the proximal end of the tube to prevent back-siphonage of water. A flange 46 is provided for securing the sillcock tube to a structure.

The components of the cartridge 14 (FIG. 1C) are contained within a housing comprised of a cartridge body 50 and a cartridge base 52 which is provided with external threads 54 to engage corresponding threads (not shown) provided on the cartridge body 50. The cartridge body base 52 includes a rotational stop in the form of hex surfaces 56 to engage corresponding surfaces provided inside the distal end of the tube 12 (FIG. 1B) so that relative rotation between them is prevented. O-rings 58 (FIG. 1C) are used on the lower end of the cartridge base 52 to sealingly engage the tube 12 (FIG. 1B). A check valve 60 (FIG. 1C) is received, largely in the cartridge base 52. Packing 62 and a ring 64 cooperate to provide a sealing connection between the cartridge body 50 and the cartridge base 52.

An internal stem 66 is provided with a key 68 (FIGS. 2 and 3) to engage a keyway or slot 70 (FIG. 1C) in a "T" ball 72. Although a T ball is shown in FIG. 1C, other balls, including the balls shown in FIGS. 8, 9, 10 and 11 may certainly be employed. O-rings 74 provide a sliding seal between the internal stem 66 and the interior of the cartridge body 50. The internal stem 66, with O-rings 74 in place, is inserted into the cartridge body 50 so that a bore, indicated at 76, is exposed outside of the cartridge body 50 for engagement with the stem 18 (FIG. 1A) and the fastener 32 (or other torque transmission mechanism). Also exposed is an upper circumferential slot 78 which is engaged by a clip 80 to hold the internal stem 66 in place during assembly. The clip 80 prevents the stem 66 from moving axially in the cartridge body 50 towards the cartridge base 52.

The ball 72 is supported between an inlet washer 82, a pair of outlet washers 84 and the key 68 (FIGS. 2 and 3) on the internal stem 66. The washers 84 are carried in recesses in the cartridge body 50, as can be seen in FIGS. 2 and 3.

The internal stem 66 further includes an axial stop 86 which takes the form of a disk. The stop 86 prevents the stem 66 from moving axially in the cartridge 14 away from the cartridge base 52. The internal stem 66 further includes a rotational stop 88 which takes the form of a key. The stop 88 cooperates with the cartridge body 50, as described below with reference to FIG. 3A, to limit the rotational movement of the stem 66 and, at the same time, the ball 72.

Figure 2:
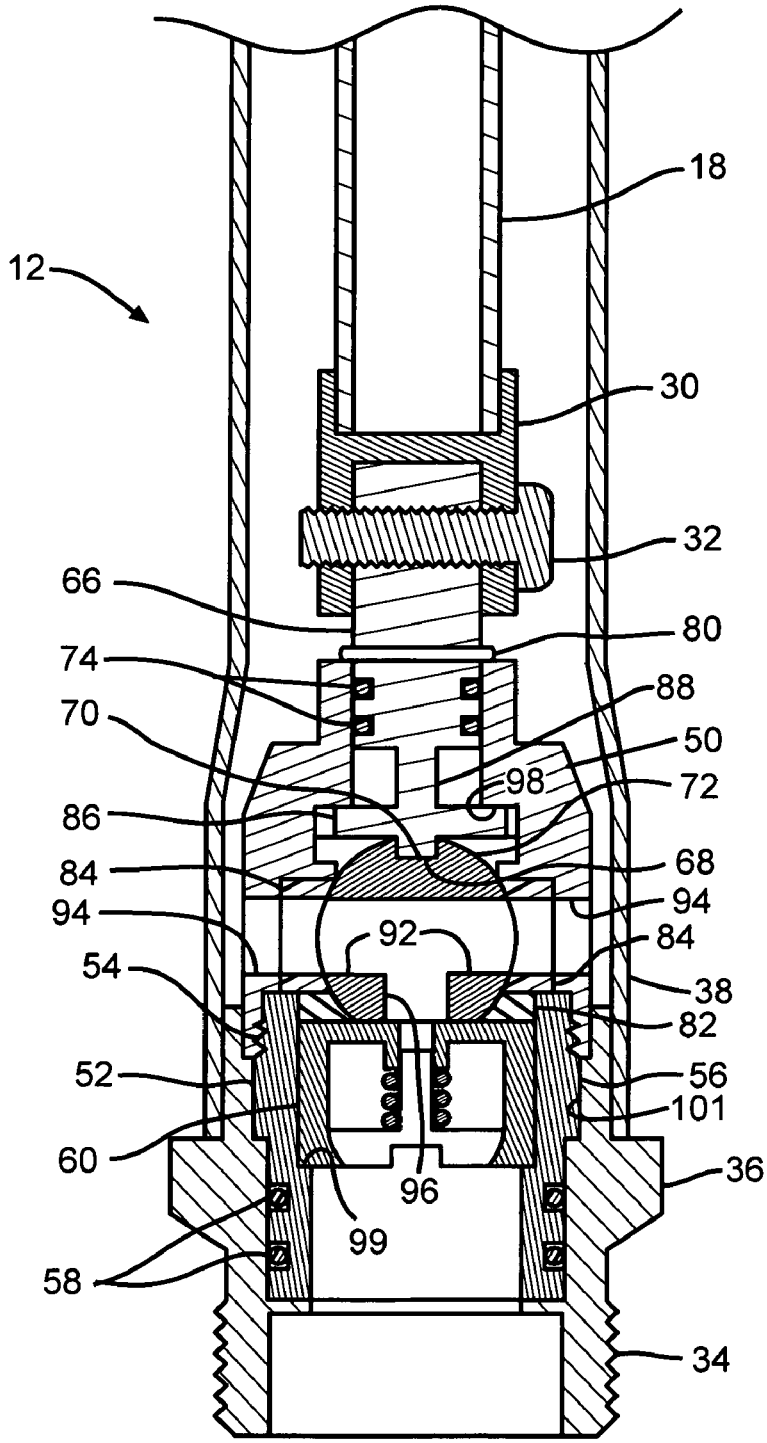
FIG. 2 is a cross sectional view showing the ball valve cartridge seated in a valve seat of a hydrant tube, with the ball valve open.
Figure 3:
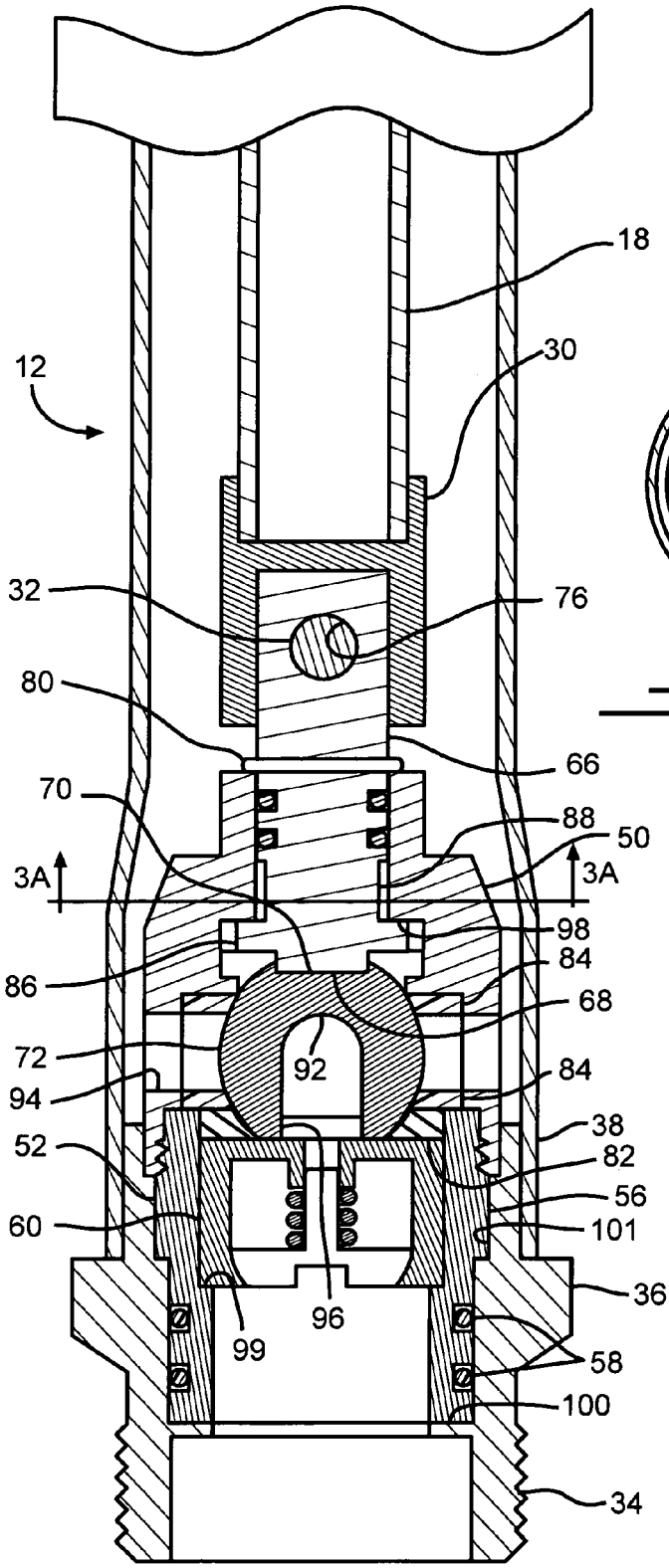
FIG. 3 is a cross section view showing the ball valve cartridge seated in a valve seat of a hydrant tube, with the ball valve closed.
Figure 3A:
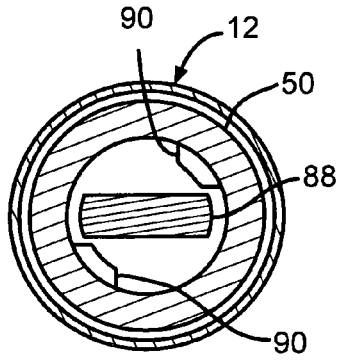
FIG. 3A is a cross sectional view, taken along the line 3A-3A of FIG. 3.

Referring now to FIGS. 2, 3 and 3A, further details concerning the ball valve cartridge 14 will be described. In FIG. 3A, a pair of ears or shoulders 90 depend from the inside of the cartridge body 50 and they cooperate with the rotational stop 88 on the internal stem 66 to limit rotation of the internal stem to a range of about ninety degrees. In the position shown in FIGS. 3 and 3A, the ball 72 prevents fluid from flowing through the ball valve cartridge 14. When the internal stem 66 is rotated ninety degrees from the position shown in FIGS. 3 and 3A, by a remote actuator acting on the stem 18, for example, the key 68 acting through the slot 70 will cause the ball 72 to rotate ninety degrees also, bringing side discharge ports 92 in the ball 72 into alignment with side discharge ports 94. In this position of the ball 72 which is shown in FIG. 2, pressurized fluid can enter and flow through the check valve 60 (which would change the appearance of the elements of the check valve although this is not reflected in FIG. 2, or FIG. 4, for that matter), into and through a fluid inlet port 96 of the ball 72, through ball discharge ports 92, through cartridge discharge ports 94 and into and through the hydrant tube 12. This corresponds with a maximum flow rate through the cartridge 14. Intermediate positions of the internal stem 66 will provide intermediate flow rates with full adjustability.

The axial position of the stem 66 within the cartridge body 50 is maintained, in part, by co-action between the axial stop 86 of the stem 66 and a shoulder 98. This co-action prevents the internal stem 66 from moving away from the cartridge base 52. When the cartridge elements are inserted into the cartridge base 52 and the cartridge body 50, and the base 52 and the body 50 are assembled, the elements inside including the check valve 60 and the ball 72, act to maintain the axial stop 86 of the internal stem in contact with the internal shoulder 98 on the cartridge body 50. The check valve is seated on an internal shoulder 99 on the cartridge base 52. Thus, the axial location of the ball 72 and the internal stem 66 are determined and maintained by the shoulders 98 and 99 and, in the embodiment shown in FIGS. 2 and 3, as well as the embodiment shown in FIG. 4, the check valve 60. The internal stem 66, the ball 72 and the check valve 60 are held captive between the shoulders 98 and 99.

When the hydrant tube 12 is secured into a valve seat (not shown) as by threads 34, for example, it will be well seated and the hex 36 can be used to apply torque to the tube to better seat it. Once the hydrant tube 12 is seated in the valve seat, it can stay there. The cartridge assembly 14, when it is attached to the stem 18, can be inserted into and removed from the proximal end of the hydrant tube 12. When the cartridge assembly 14 is inserted into the tube 12 and advanced to the position shown in FIGS. 2 and 3, it is seated against a shoulder seat 100 formed inside the tube 12 and O-rings 58 provide a seal between the inside of the tube 12 and the outside of the cartridge assembly 14. Relative rotation between the cartridge assembly 14 and the hydrant tube 12 is prevented by co-action between the cartridge base hex surfaces 56 and corresponding internal flat surfaces 101 inside of the hydrant tube 12. Thus, when torque is applied to the internal stem 66 of the cartridge assembly 14 enough to cause it to rotate, the stem 66 and the ball 72 rotate relative to the cartridge body 50 and the cartridge base 52.

Figure 4:
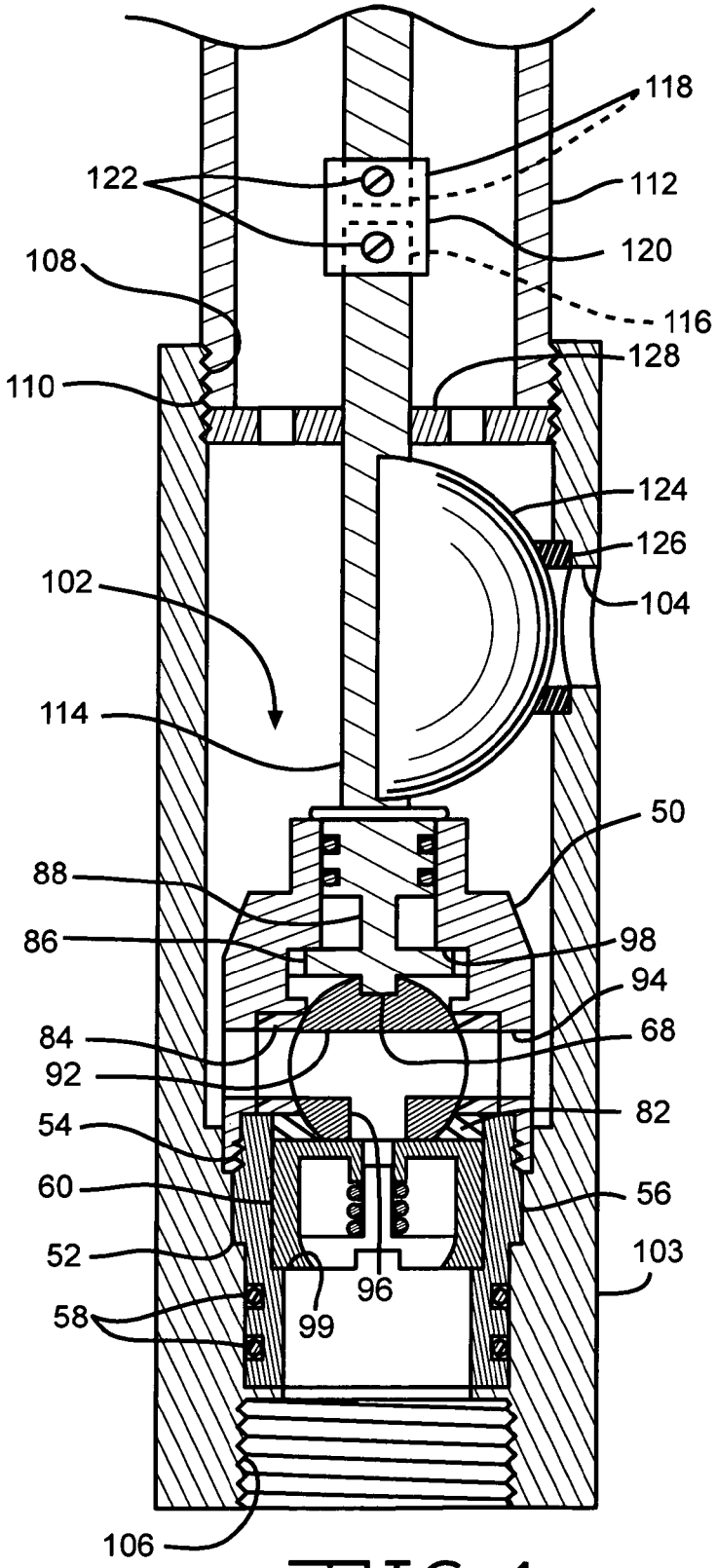
FIG. 4 is a view, partially in cross section, showing a second embodiment of a ball valve cartridge seated in a freezeless yard hydrant with a drain hole valve.

A ball valve cartridge 102 is shown in FIG. 4 in combination with a self draining feature suitable for a yard hydrant application. The ball valve cartridge 102 is similar in many respects to the cartridge 14 and like reference numerals have been used to refer to like parts between the cartridges. A housing 103 is provided with a drain hole indicated at 104 through water is to be drained when the hydrant is not in use. The housing 103 has an internally threaded opening indicated at 106 for attaching the housing 103 to a source for fluid under pressure. Typically, this connection will be underground and below the frost line. At an upper end, the housing 103 has an internally threaded outlet 108 that cooperates with an externally threaded end 110 of a discharge conduit 112 to support the conduit 112 relative to the housing 103. This connection, again, typically, will be underground and below the frost line. The discharge conduit extends upwardly through the ground to a discharge outlet (not shown) and a support for an actuator (not shown) for the ball valve cartridge 102.

The cartridge 102 includes an internal stem 114 which includes a portion inside of the cartridge body 50 that is the same as the corresponding portion of the internal stem 66 (FIGS. 1C, 2, 3 and 3A). The portion of the stem 114 that is outside of the cartridge body 50 terminates in a torque input region 116 for receiving torque transmitted to it from an external stem 118 through a coupler 120. Fasteners 122 connect the coupler 120 to the external stem 118 and to the internal stem 114 in torque transmitting connections so that torque applied to the external stem 118 is transmitted to the internal stem 114 to operate the ball valve cartridge 102 substantially as described above for the operation of the ball valve cartridge assembly 14.

Secured to the external stem 118 is a hemispherical valve element 124 which is supported adjacent to the drain hole 104 in sealing engagement with a washer 126 which surrounds the drain hole 104 on the inside of the housing 103. The stem 114 is centered in the housing 103 at the distal end by co-action between the housing 103 and the cartridge base 52 and is centered, at the proximal end, by a perforated disk 128. The disk can be secured to the stem 114 and made of a resilient material so that it can be withdrawn from the conduit 112 for repair or replacement of the cartridge 102. This will provide a good sliding seal between the valve element 124 and the washer 126.

Figures 5, 6, 7:
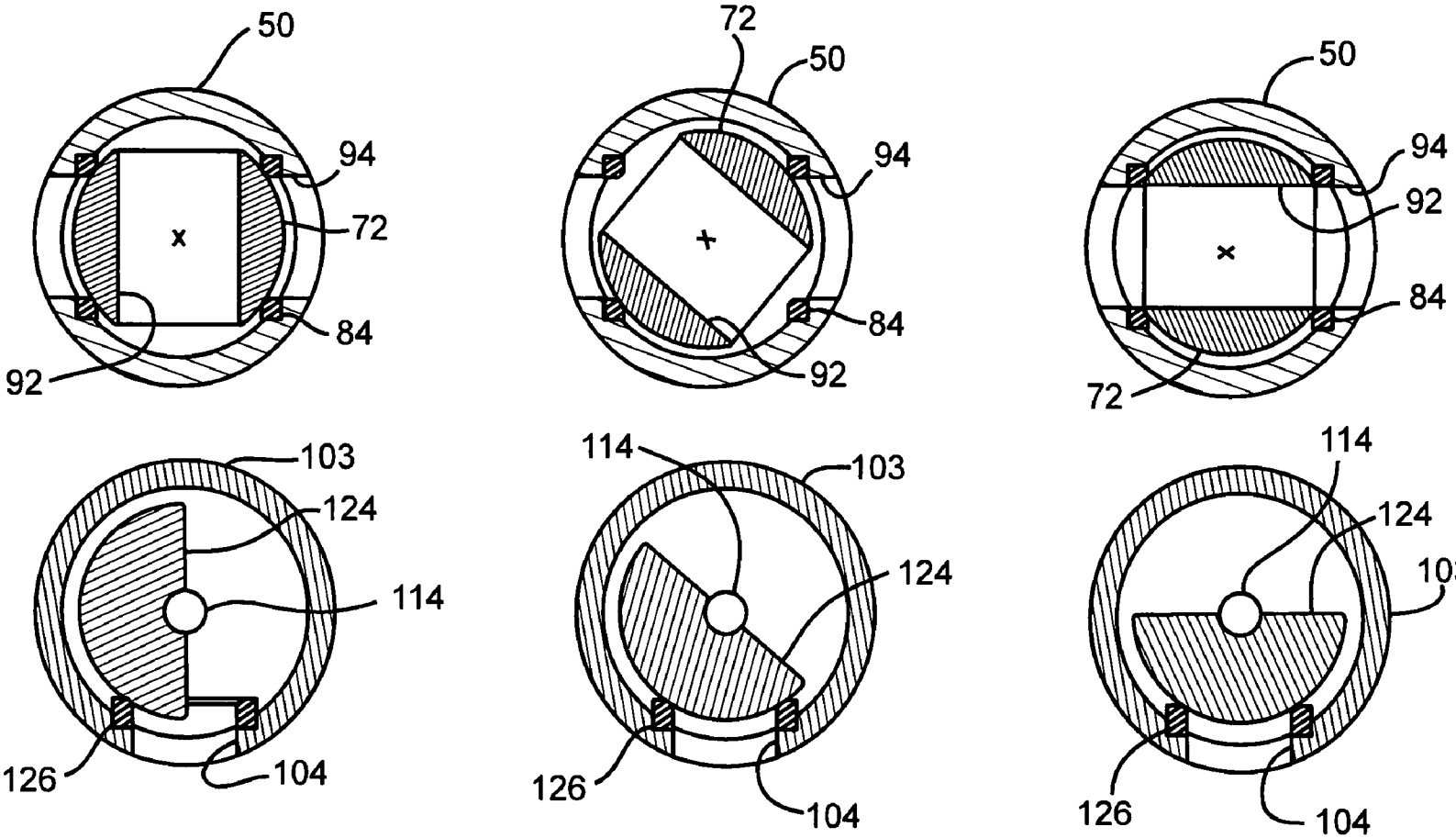
FIG. 5 is a split cross sectional view showing the relative rotational positions for the ball valve and the drain hole valve of the hydrant shown in FIG. 4 when water flow is shut off.
FIG. 6 is a split cross sectional view showing the relative rotational positions for the ball valve and the drain hole valve of the hydrant shown in FIG. 4 when water flow is beginning.
FIG. 7 is a split cross sectional view showing the relative rotational position for the ball valve and the drain hole valve of the hydrant shown in FIG. 4 when water flow is at full rate.

With the stem 114 in the position shown in FIG. 4, the drain hole is closed by the valve element 124 and the ball valve is in a full flow position with the discharge ports 92 of the ball 72 aligned with the discharge ports 94 of the cartridge body 50. This condition is represented in FIG. 7 which shows the ball 72 with discharge ports 92 aligned with cartridge discharge ports 94 and the valve element 124 completely closing off the drain hole 104. As the stem 114 is rotated from the position represented in FIGS. 4 and 7 to the position represented in FIG. 6, the valve element 124 keeps the drain hole 104 closed or blocked but the flow of water through the ball 72 and out of the cartridge body 50 is getting restricted. As the stem 114 is rotated from the position represented in FIG. 6 to the position represented in FIG. 5, the valve element 124 reaches an angular orientation where it opens the drain hole 104, just as the flow of water through the ball 72 and out of the cartridge body 50 is stopped. This sequence of operation occurs over the brief angular rotation of a total of about ninety degrees or a quarter turn of a handle (not shown). Of course, the ball valve cartridge may be combined with other, different, hydrant draining mechanisms including those that are known and those that are yet to be invented.

Referring now to FIGS. 8 through 11, the ball 72 and other balls with alternative designs, all for use in a ball valve cartridge according to the present invention or in any ball valve, for that matter, are illustrated.

Figure 8:
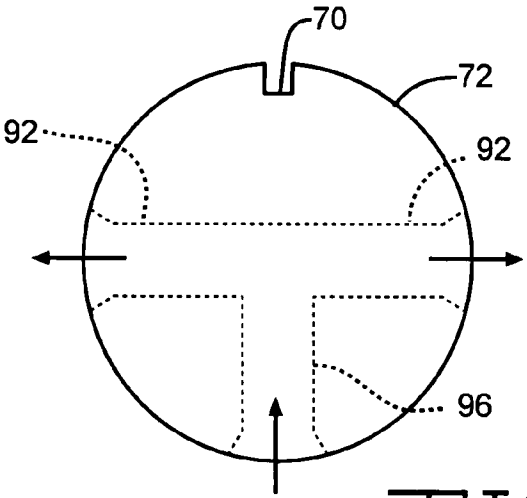
FIG. 8 is a side view of a ball suitable for use in a ball valve cartridge according to the invention.

Ball 72 is shown in FIG. 8 and it has fluid inlet 96 which is in fluid communication with two transverse fluid outlets 92, each one having an axis that is at right angles to the axis of the fluid inlet 96. The keyway 70 cooperates, as described above, with a key to, first of all, keep the ball 72 oriented in the cartridge body 50 (FIGS. 2, 3 and 4) and, also, to transmit torque to the ball 72 to cause it to rotate from a closed position to an open position and back again. Fluid discharge openings 94 in the cartridge body 50 are suitably sized, shaped and positioned, relative to the fluid discharge openings 92 in the ball 72 so that fluid can flow out of the openings 92 and out of the openings 94.

Figure 9:
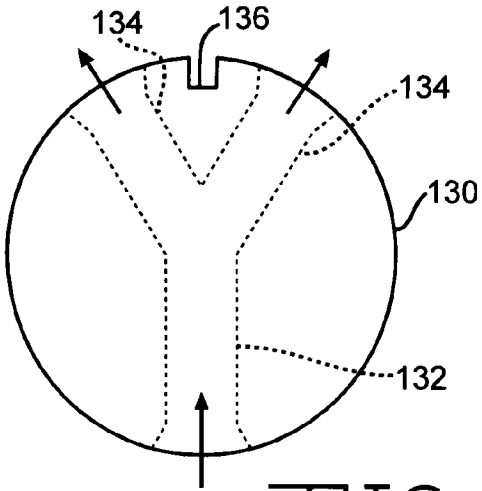
FIG. 9 is a side view of a second embodiment of a ball suitable for use in a ball valve cartridge according to the invention.

A ball 130 is shown in FIG. 9 and it has a fluid inlet 132 which is in fluid communication with two semi-transverse fluid outlets 134, each one having an axis that forms an angle with the axis of the other discharge opening of about eighty degrees. With the fluid inlet 132, the fluid outlets form something resembling a Y-shaped passageway. A keyway 136 cooperates, as described above, with a key to, first of all, keep the ball 130 oriented in, for example, a cartridge body and, also, to transmit torque to the ball 130 to cause it to rotate from a closed position to an open position and back again. Fluid discharge openings in a cartridge body would be suitably sized, shaped and positioned, relative to the fluid discharge openings 134 in the ball 130 so that fluid can flow out of the openings 134 and out of the discharge openings in the cartridge. This design reduces turbulence inside the ball and would be well suited for high flow rates.

Figure 10:
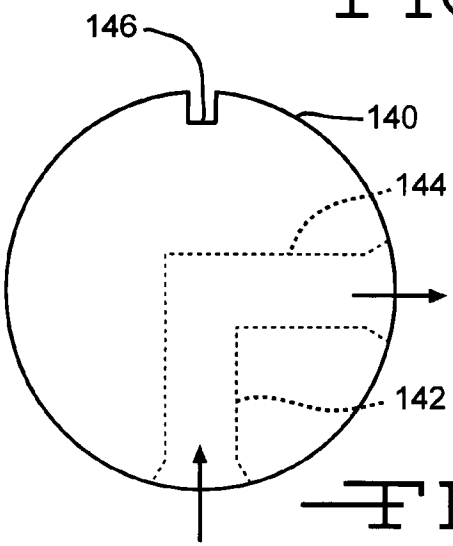
FIG. 10 is a side view of a third embodiment of a ball suitable for use in a ball valve cartridge according to the invention.

A ball 140 is shown in FIG. 10 and it has a fluid inlet 142 which is in fluid communication with a transverse fluid outlet 144. The outlet 144 has an axis which forms a right angle with the axis of the inlet 142. A keyway 146 cooperates, as described above, with a key to, first of all, keep the ball 140 oriented in, for example, a cartridge body and, also, to transmit torque to the ball 140 to cause it to rotate from a closed position to an open position and back again. A fluid discharge opening in a cartridge body would be suitably sized, shaped and positioned, relative to the fluid discharge opening 144 in the ball 140 so that fluid can flow out of the opening 144 and out of the discharge opening in the cartridge.

Figure 11:
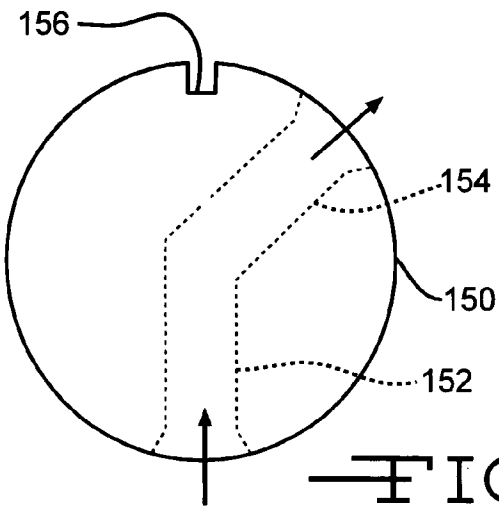
FIG. 11 is a side view of a fourth embodiment of a ball suitable for use in a ball valve cartridge according to the invention.

A ball 150 is shown in FIG. 11 and it has a fluid inlet 152 which is in fluid communication with a semi-transverse fluid outlet 154. The axis of the fluid outlet 154 forms an angle with the axis of the fluid inlet 152 and that angle is an obtuse angle. A keyway 156 cooperates, as described above, with a key to, first of all, keep the ball 150 oriented in, for example, a cartridge body and, also, to transmit torque to the ball 150 to cause it to rotate from a closed position to an open position and back again. A fluid discharge opening in a cartridge body would be suitably sized, shaped and positioned, relative to the fluid discharge opening 154 in the ball 150 so that fluid can flow out of the opening 154 and out of the discharge opening in the cartridge with minimal turbulence. This design reduces turbulence inside the ball 150 and would be well suited for high flow rates.

It will be appreciated that considerable departures from the specific details of the embodiments of the invention described above, are possible without departing from the spirit and scope of the inventions as it is defined in the following claims.

I claim:

1. A ball valve cartridge and stem assembly for use in a hydrant tube having a hydrant valve seat at one end and a rotatable ball valve actuator support at the other end, said ball valve cartridge and stem assembly comprising a cartridge housing having a first end and a second end, said cartridge housing comprising
a fluid inlet at said first end,
a fluid outlet,
a hydrant valve seat seal,
a hydrant valve seat rotational stop,
a first stop surface,
a second stop surface and
a ball seat, a ball rotationally supported inside said cartridge housing for rotation between a first position and a second position, said ball comprising
a fluid inlet,
a fluid outlet and
a keyway,
a ball key comprising
a key for engaging said ball keyway for transmitting torque from said ball key to said ball to cause it to rotate between said first position and said second position,
a shaft extending to and through said second end of said cartridge housing,
a first shoulder for slidingly engaging said first stop surface of said cartridge housing so that axial movement of said ball key towards said second end of said cartridge housing is prevented by said engagement,
a second shoulder which engages said second stop surface of said cartridge housing to prevent rotation of said ball beyond said first or second position, and
a stem connected to said ball key so that torque applied to said stem is transmitted to said ball key.

2. The ball valve cartridge and stem assembly claimed in claim 1 which further comprises a check valve inside of said cartridge housing between said cartridge housing fluid inlet and said ball fluid inlet.

3. The ball valve cartridge and stem assembly claimed in claim 2 wherein said check valve includes an axial stop that cooperates with said cartridge housing to prevent axial movement of said check valve towards said first end of said cartridge housing.

4. The ball valve cartridge and stem assembly claimed in claim 3 wherein said ball is held axially captive between said ball key and said check valve.

5. The ball valve cartridge and stem assembly claimed in claim 4 wherein said cartridge housing is comprised of a cartridge body and a cartridge base.

6. The ball valve cartridge and stem assembly claimed in claim 1 wherein said ball fluid inlet has an axis and it is co-axial with the axis of said cartridge housing.

7. The ball valve cartridge and stem assembly claimed in claim 6 wherein said ball fluid outlet has an axis and it is transverse to the axis of said cartridge housing.

8. A ball valve cartridge assembly for use with a remote actuator, said ball valve cartridge and stem assembly comprising
a cartridge housing having a first end and a second end, said cartridge housing comprising
a fluid inlet at said first end,
a fluid outlet,
a first stop surface,
a second stop surface and
a ball seat,
a ball rotationally supported inside said cartridge housing for rotation between a first position and a second position, said ball comprising
a fluid inlet,
a fluid outlet and
a keyway, and
a ball key comprising
a key for engaging said ball keyway for transmitting torque from said ball key to said ball to cause it to rotate between said first position and said second position,
a shaft extending to and through said second end of said cartridge housing, said shaft having a torque input section,
an axial stop that slidingly engages said first stop surface of said cartridge housing so that axial movement of said ball key towards said second end of said cartridge housing is prevented by said engagement, and
a rotational stop which engages said second stop surface of said cartridge housing to prevent rotation of said ball beyond said first or second position.

9. The ball valve cartridge assembly claimed in claim 8 which further comprises a check valve inside of said cartridge housing between said cartridge housing fluid inlet and said ball fluid inlet.

10. The ball valve cartridge assembly claimed in claim 9 wherein said check valve includes an axial stop that cooperates with said cartridge housing to prevent axial movement of said check valve towards said first end of said cartridge housing.

11. The ball valve cartridge assembly claimed in claim 10 wherein said ball is held axially captive between said ball key and said check valve.

12. The ball valve cartridge assembly claimed in claim 11 wherein said cartridge housing is comprised of a cartridge body and a cartridge base.

13. The ball valve cartridge assembly claimed in claim 8 wherein said ball fluid inlet has an axis and it is co-axial with the axis of said cartridge housing.

14. The ball valve cartridge claimed in claim 13 wherein said ball fluid outlet has an axis and it is transverse to the axis of said cartridge housing.

15. A hydrant comprising
a hydrant tube having a first end and a second end,
an actuator supported for rotational movement at said first end of said hydrant tube,
a ball valve cartridge assembly comprising
a cartridge housing having a first end and a second end, said cartridge housing comprising
a fluid inlet at said first end,
a fluid outlet,
a hydrant valve seat seal,
a hydrant valve seat rotational stop,
a first stop surface,
a second stop surface and
a ball seat,
a ball rotationally supported inside said cartridge housing for rotation between a first position and a second position, said ball comprising
a fluid inlet,
a fluid outlet and
a keyway,
a ball key comprising
a key for engaging said ball keyway for transmitting torque from said ball key to said ball to cause it to rotate between said first position and said second position,
a shaft extending to and through said second end of said cartridge housing,
a first shoulder for slidingly engaging said first stop surface of said cartridge housing so that axial movement of said ball key towards said second end of said cartridge housing is prevented by said engagement,
a second shoulder which engages said second stop surface of said cartridge housing to prevent rotation of said ball beyond said first or second position, and
a stem connecting said actuator to said ball key so that torque applied to actuator is transmitted to said ball key.

16. The hydrant claimed in claim 15 which further comprises a check valve inside of said cartridge housing between said cartridge housing fluid inlet and said ball fluid inlet.

17. The hydrant claimed in claim 16 wherein said check valve includes an axial stop that cooperates with said cartridge housing to prevent axial movement of said check valve towards said first end of said cartridge housing and wherein said ball is held axially captive between said ball key and said check valve.

18. The hydrant claimed in claim 17 wherein said cartridge housing is comprised of a cartridge body and a cartridge base.

19. The hydrant claimed in claim 15 wherein said ball fluid inlet has an axis and it is co-axial with the axis of said cartridge housing and wherein said ball fluid outlet has an axis and it is transverse to the axis of said cartridge housing.

20. The hydrant claimed in claim 15 wherein said hydrant tube has a drain hole and wherein said hydrant further comprises a drain hole valve element mounted for rotation with said ball key shaft, outside of said ball valve cartridge housing.

* * * * *